US005701813A

United States Patent [19]

Smith

[11] Patent Number: 5,701,813

[45] Date of Patent: Dec. 30, 1997

[54] PET DOOR FOR SCREEN APPLICATIONS

[76] Inventor: John Michael Smith, HCOI Box 339, Cleveland, Tex. 77327-8004

[21] Appl. No.: 609,839

[22] Filed: Mar. 1, 1996

[51] Int. Cl.[6] ..... E06B 7/28

[52] U.S. Cl. ..... 160/180; 160/371; 49/170

[58] Field of Search ..... 160/180, 116, 160/381, 371; 49/170, 169

[56] References Cited

U.S. PATENT DOCUMENTS

| | | | |
|---|---|---|---|
| 2,174,800 | 10/1939 | McDonald | 160/379 X |
| 2,470,129 | 5/1949 | Bemis et al. | 160/379 X |
| 3,985,174 | 10/1976 | Bricker | 160/180 |
| 4,053,007 | 10/1977 | Griffith | 160/180 |
| 4,334,573 | 6/1982 | Hackman et al. | 160/180 |
| 4,603,724 | 8/1986 | Borwick | 160/180 |
| 4,760,872 | 8/1988 | Hale, Jr. | 160/180 X |
| 5,117,890 | 6/1992 | Taylor et al. | 160/180 |
| 5,485,705 | 1/1996 | Guillemet | 160/381 X |

*Primary Examiner*—Blair Johnson

[57] ABSTRACT

Presented is a pet door for screen applications with framing members similar to that used in existing screen doors and screen windows. The pet door comprises interchangeable and reversible parts capable of being combined in a manner to acheive a configuration adaptable to the various types of screen frames that the device is installed on. To provide a rigid attachment of the pet door to the existing screen frame, mounting brackets are used. When installed, the pet door provides a rigid and safe access for pets to enter or exit a residence.

3 Claims, 3 Drawing Sheets

PET DOOR FOR SCREEN APPLICATIONS

BACKGROUND OF THE INVENTION

Various pet access doors are available for use with screened areas such as screen doors and screen windows. These pet doors are intended to provide access for pets to enter or exit a dwelling without assistance. The opening used by the pets is typically covered by a flexible material such as screen, vinyl, or rubber to keep insects from entering the residence.

U.S. Pat. No. 5,117,890 issued to Taylor et al on Jun. 2, 1992 describes a pet door for use in a screen door. While this type of device is practical, it requires considerable effort to change the size for various applications. In addition, the frame does not attach to the screen door frame it is installed on. Rather, it rests in the body of the screen door and relies on the screen for support. The screen of the door is terminated at this type of pet door by being caught by opposing pieces. U.S. Pat. No. 4,334,573 issued to Hackman et al on Jun. 15, 1982 is similar in that it does not attach to the door frame it is installed on and the screen is restrained by opposing pieces.

U.S. Pat. No. 4,053,007 issued to Griffith on Oct. 11, 1997 provides for a rigid mounting to the screen door it is installed on but is not easily adaptable to various screen doors and screen windows of differing dimensions. This type of device is also difficult to install using a complicated frame. U.S. Pat. No. 3,985,174 issued to Bricker on Oct. 12, 1976 also provides for a rigid mounting. However, the framing of the opening and the pet door itself are difficult to change in size and the installation required is extensive. The Bricker device uses a groove/spline method for securing the screen to the pet door frame. However, the part of the frame incorporating the use of the spline is one piece of a three piece system with a different frame element supporting the actual door flap. Both the Griffith and Bricker pet doors can result in interference problems that restrict the use of the screen door they are installed on. Clearances are such that the screen door, after pet door installation, can in some cases be only partially opened. Neither device readily takes into account that various screen frames are different in both thickness and screen to frame connection.

The present invention incorporates a solution to these problems in its design. One of the objectives is to provide a versatile pet door that can be easily adapted for installation on various types of screen doors and screen windows. Another objective of the invention is to provide a pet door that rigidly attaches to the frame of the screen it is installed on without interfering with its use or relying on the screen for sole support. In addition, the present invention is to use framing members similar to that used in screen doors and screen windows to provide for a clean transition of existing screen to pet door frame. Another consideration of the present invention is to provide an inexpensive device that in all applications is safe for pets to use.

BRIEF DESCRIPTION OF THE INVENTION

Accordingly, the present invention relates to a pet door for screen applications such as screen windows and screen doors. The invention uses framing members similar to that used in existing screen frames and when installed in the lower corner of a screen door or window define a rectangular opening for pet access. The horizontal and vertical framing members are rigidly connected to each other by a corner bracket that is secured by threaded fasteners. Both an upper and lower mounting bracket are used to rigidly attach the framing members to the frame of the screen window or door the pet door is installed on. This is accomplished by the use of threaded fasteners such as sheet metal screws or a bolt/nut connection. The horizontal and vertical framing members have a groove to provide for a clean connection of framing member to existing screen. A mounting plate attaches a door flap to the upper framing member providing a pivot point. The door flap being of a size nearly equal to the size of the opening defined by the framing members, allows the pet access by pushing on the flexible material.

Thus, according to the present invention, a screen door or window can have installed on it a pet door by mounting the assembly on the screen application and cutting away the screen in the opening defined by the framing members. The assembly, if desired, can be easily reversed for mounting in either the left or right hand corner of the screen application. In addition, the framing members can be easily reversed if necessary, to provide for a cleaner alignment with the existing screen. Simple modifications to the framing members, door flap mounting plate, and door flap can easily be made to change the size of the opening if desired.

DESCRIPTION OF THE PREFERRED EMBODIMENTS

Figure 1:
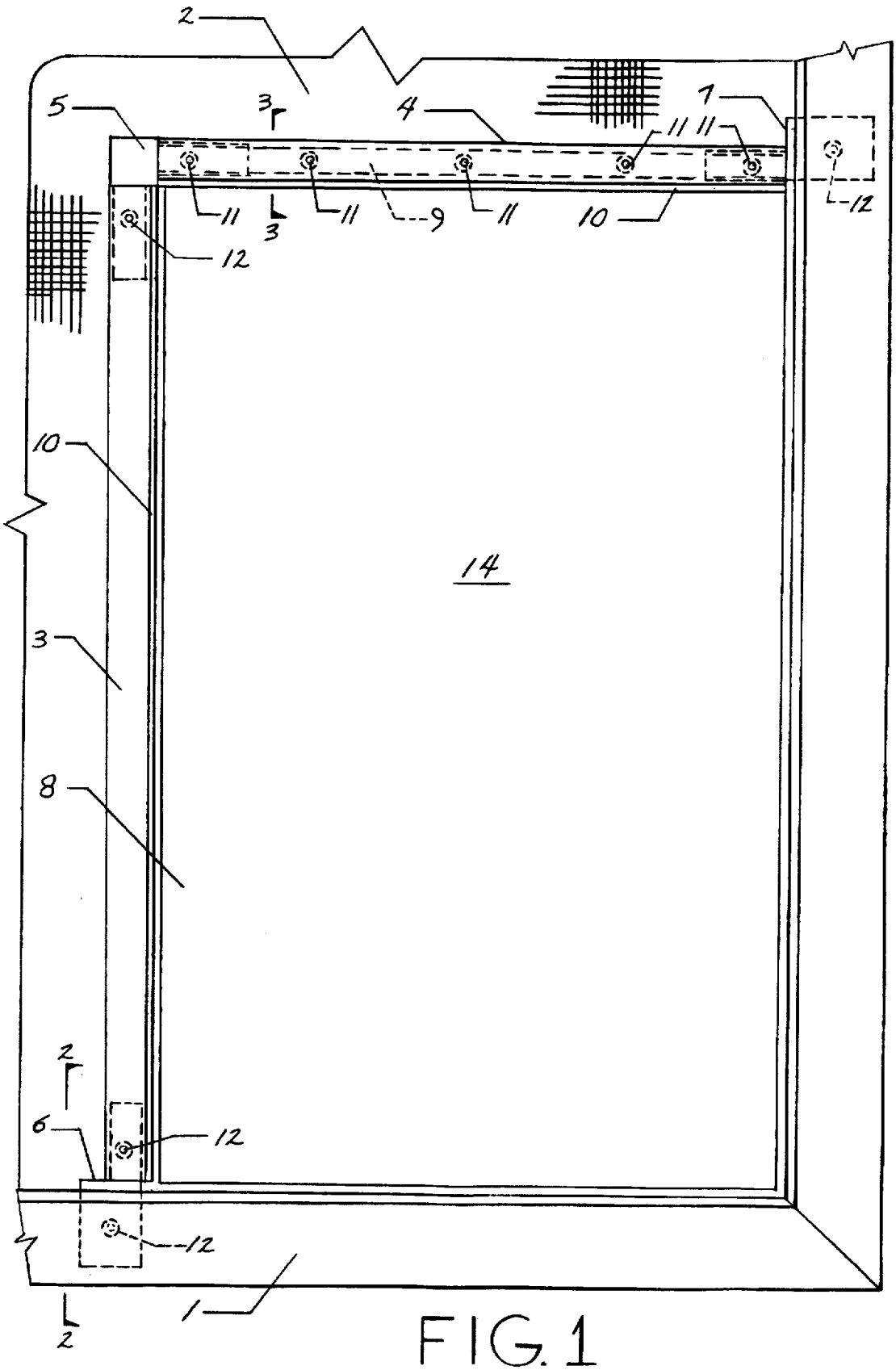
FIG. 1 is an elevation view of the pet door invention as installed in an existing screen frame with the view being inside looking out.

Referring to FIG. 1, a pet door 14 is shown as installed in a lower corner of an existing frame 1 having screen 2. A vertical framing member 3 and a horizontal framing member 4 define a rectangular opening. A corner bracket 5 connects a vertical framing member 3 to a horizontal framing member 4 by threaded fasteners 11 and 12. A horizontal framing member 4 is secured to an upper mounting bracket 7 by a threaded fastener 11. A vertical framing member 3 is attached to a lower mounting bracket 6 by a threaded fastener 12. The opening defined by the framing members is covered by flexible vinyl or rubber material making a door flap 8 and is attached to the pet door frame at the horizontal framing member 4 only.

Figure 2:
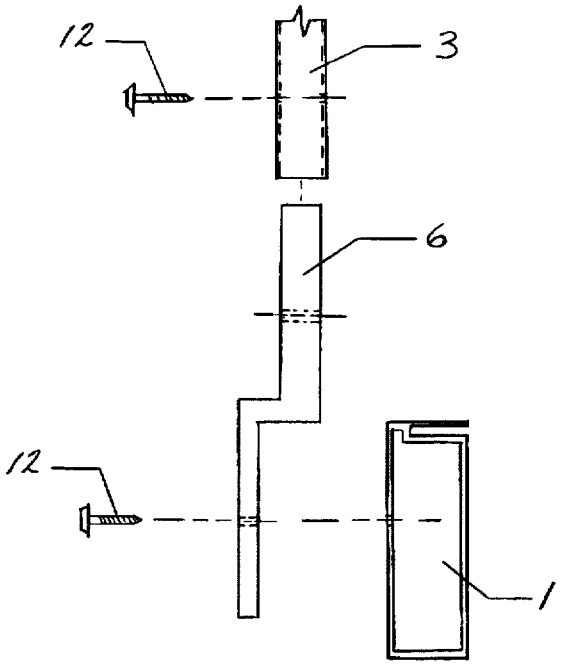
FIG. 2 is an exploded cross-section view taken at 2—2 of FIG. 1.

The material used in the horizontal framing member 4 and the vertical framing member 3 is preferably metal, hollow, and manufactured with a groove for screen attachment using spline. Such a material that is readily available is common screen type molding. These factors are used to their greatest benefit in the present pet door invention. Referring to FIG. 2, a lower mounting bracket 6 has an upper portion that fits inside a vertical framing member 3. The connection is made rigid by a threaded fastener 12. The details of the part relationship are further illustrated in FIG. 5. The end of the lower mounting bracket 6 is offset so that the vertical framing member 3, when installed, aligns with the existing frame 1 and existing screen 2. The upper mounting bracket 7 to horizontal framing member 4 connection is similar being opposite in hand. The mounting brackets 6 and 7 are preferably metal and can be machined or die-cast.

Figure 3:
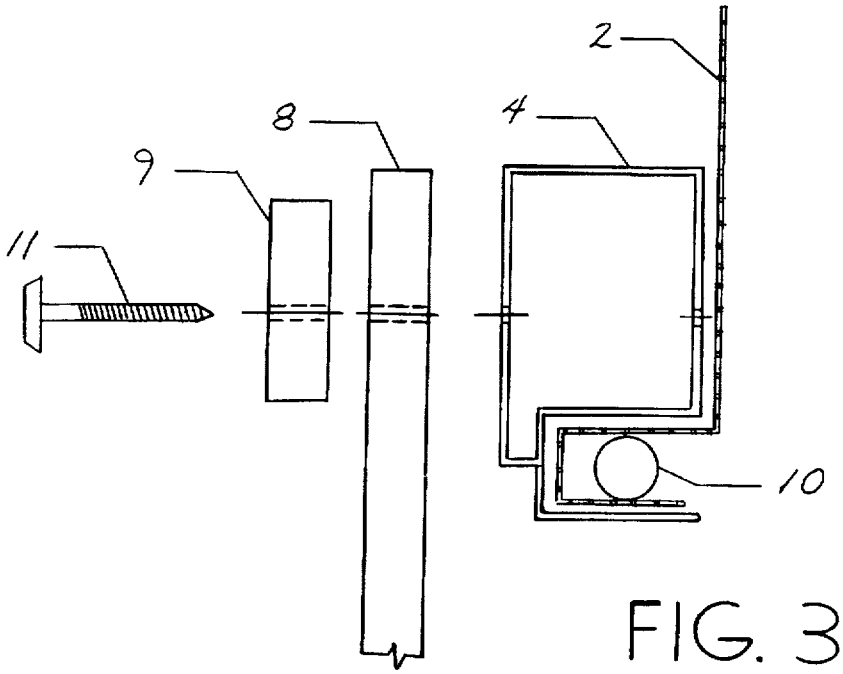
FIG. 3 is an exploded cross-section view taken at 3—3 of FIG. 1.

The view shown in FIG. 3 is an end view of the horizontal framing member 4. A door flap 8 is secured to a horizontal framing member 4 by a mounting plate 9 and the threaded fasteners 11. A mounting plate 9 and a horizontal framing member 4 are of equal length providing for an upper pivoting point for the door flap 8.

Figure 4:
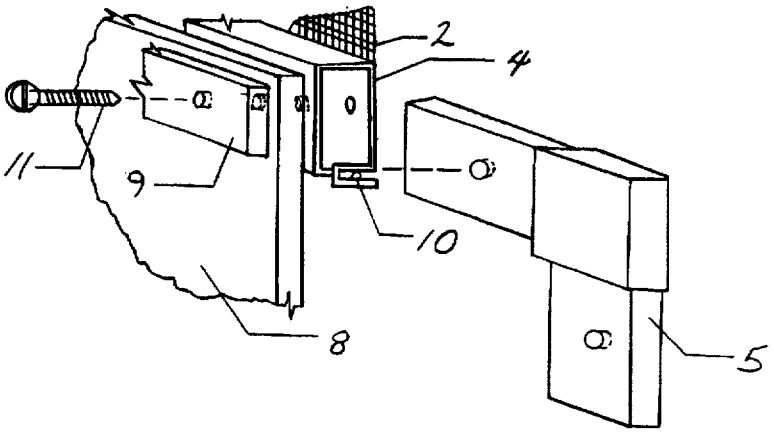
FIG. 4 is an exploded isometric view showing framing and door flap mounting details.

FIG. 4 shows a corner bracket 5. A vertical framing member 3 is connected to a horizontal framing member 4 by a corner bracket 5 and the threaded fasteners 11 and 12. The ends of a corner bracket 5 fit inside the respective framing members 3 and 4. The corner bracket 5 is preferably metal and can be machined or die-cast.

Installation of the pet door 14 is accomplished by positioning it at the desired location. Holes are drilled in the existing frame 1 at the upper mounting bracket 7 and lower mounting bracket 6 locations. The pet door 14 is then secured to the existing frame 1 by threaded fasteners 12. The existing screen 2 is then cut at the bottom and side of the frame 1 within the rectangular area defined by the framing members. The spline 10 is then used to attach the screen 2 to the horizontal framing member 4 and the vertical framing member 3. The excess screen 2 is then trimmed off clearing the opening for the door flap 8.

Figure 5:
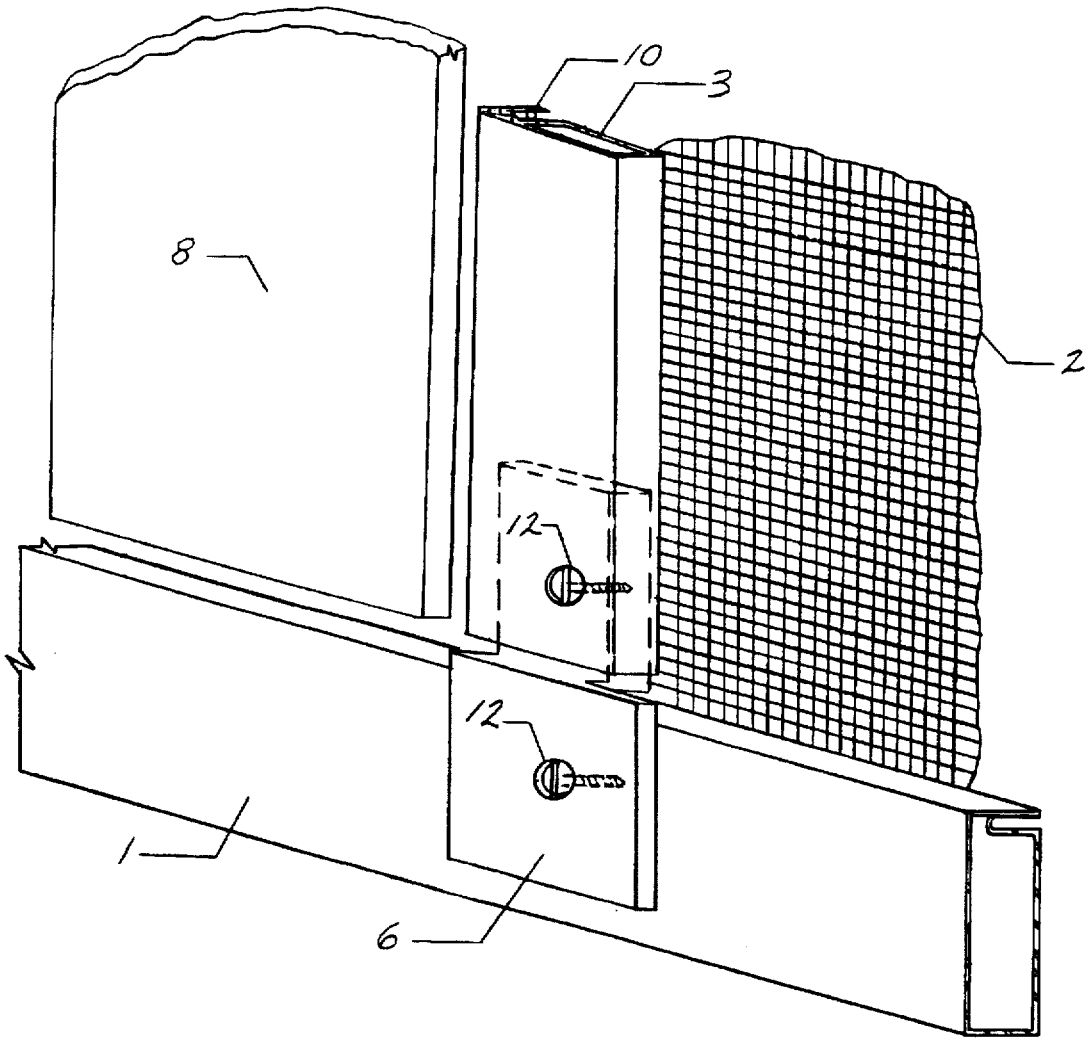
FIG. 5 is an exploded isometric view showing mounting bracket details.

In some installations, to eliminate interference problems, no part of the pet door 14 should protrude past the plane defined by the existing frame 1 and existing screen 2 on the inside face as shown in FIG. 5. To account for this situation, the upper mounting bracket 7 and the lower mounting bracket 6 can be turned relative to their respective framing members by removing the associated fastener, removing, turning, and re-installing the mounting brackets in the desired position. The upper mounting bracket 7 can also be changed with the lower mounting bracket 6 to insure the opening defined by the framing members is clear of obstructions. The horizontal framing member 4 can be turned in a similar manner to insure that the mounting plate 9 and the door flap 8 are within or outside the plane of the existing frame 1. This procedure provides for an inside or outside mounting of the pet door 14 so that it does not interfere with the use of the screen it is installed on.

For most installations, the spline groove of the framing members 3 and 4 needs to be aligned with the spline groove of the existing frame 1 as shown in FIG. 5. Both the horizontal framing member 4 and the vertical framing member 3 can be turned such that the spline groove faces in or out by removing the associated fasteners, placing the framing member in the desired orientation, and reattaching the fasteners. This ability allows for the cleanest possible connection of existing screen 2 to pet door 14.

Thus, there has been described a pet door for screen applications with framing members similar to that used in existing screen frames. The pet door provides for a rigid mounting to the existing frame of the screened area the device is used on. The ability to change the configuration of the component parts enables the pet door to be installed on various screened areas such as screen doors, screen windows, screen storm doors, and screened in porches.

I claim:

1. In combination with a screen and screen frame in a given plane, said frame having a bottom and an intersecting side, the perimeter of said screen being attached to said frame forming a corner of a generally rectangular screened enclosure, a pet door for screen applications comprising:

a cut-out portion in said screen defining an opening, said opening having a top and a side defined by said screen and a side and a bottom defined by said frame, said opening being generally rectangular in shape;

a horizontal framing member having a length substantially equal to said top of said opening and having a spline groove, said screen at the top of said opening defined by said screen being attached to said horizontal framing member by spline material;

a vertical framing member having a length substantially equal to said side of said opening defined by said screen and having a spline groove, said screen at the side of said opening defined by said screen being attached to said vertical framing member by spline material;

a corner bracket joining said horizontal framing member to said vertical framing member at the intersection of the top and side of said opening defined by said screen;

an upper mounting bracket joined to said horizontal framing member and attached to said frame at the side of said opening defined by said frame;

a lower mounting bracket joined to said vertical framing member and attached to said frame at the bottom of said opening defined by said frame; and a flexible flap and mounting plate joined to said horizontal framing member only, said flap being aligned between said mounting plate and said horizontal framing member, said flap being nearly equal in size to said opening, said flap being moveable pivoting about an axis at said horizontal framing member permitting the passage of a pet through said opening.

2. A pet door for screen applications as in claim 1 wherein:

said upper mounting bracket has one end which is offset providing for alignment of said horizontal framing member with said frame in said plane; and said lower mounting bracket has one end which is offset providing for alignment of said vertical framing member with said frame in said plane.

3. A pet door for screen applications as in claim 2 wherein:

said upper mounting bracket is detachable from said horizontal framing member;

said lower mounting bracket is detachable from said vertical framing member;

said corner bracket is detachable from said horizontal framing member and said vertical framing member; and said flap and said mounting plate are detachable from said horizontal framing member.

* * * * *